United States Patent [19]

Marans

[11] 3,956,157

[45] May 11, 1976

[54] DETERGENT AND BLEACHING AGENT COMPRISING SODIUM PERBORATE AND SODIUM α-GLUCOHEPTONATE AND SODIUM β-GLUCOHEPTONATE

[75] Inventor: Nelson S. Marans, Silver Spring, Md.

[73] Assignee: W. R. Grace & Co., New York, N.Y.

[22] Filed: July 19, 1974

[21] Appl. No.: 490,120

[52] U.S. Cl. ..... 252/95; 252/99; 252/135; 252/186; 252/DIG. 11

[51] Int. Cl.[2] ..... C11D 3/395

[58] Field of Search ..... 252/95, 99, DIG. 11, 252/186, 135

[56] References Cited

UNITED STATES PATENTS

| | | | |
|---|---|---|---|
| 3,116,105 | 12/1963 | Kerst | 252/DIG. 11 |
| 3,217,034 | 11/1968 | Karabinos et al. | 252/DIG. 11 |
| 3,539,464 | 11/1970 | Harper et al. | 252/DIG. 11 |
| 3,759,833 | 9/1973 | Bannerman et al. | 252/95 |
| 3,764,356 | 10/1973 | Sams | 252/135 X |

*Primary Examiner*—Mayer Weinblatt
*Attorney, Agent, or Firm*—Elton Fisher

[57] ABSTRACT

An aqueous solution useful as a detergent and bleach is prepared by dissolving an admixture of sodium perborate, sodium α-glucoheptonate, and sodium β-glucoheptonate in water; the water can be evaporated to form a free flowing particulate solid useful as a detergent and bleach.

7 Claims, No Drawings

DETERGENT AND BLEACHING AGENT COMPRISING SODIUM PERBORATE AND SODIUM <-GLUCOHEPTONATE AND SODIUM >-GLUCOHEPTONATE

BACKGROUND OF THE INVENTION

This invention is in the field of detergents and bleaching agents. More specifically, this invention is directed to a detergent which is also a bleaching agent. Still more specifically, this invention is directed to a composition useful as a detergent and as a bleach-said composition being formed from sodium perborate and a mixture consisting essentially of equal molar portions of sodium α-glucoheptonate and sodium β-glucoheptonate.

The composition of this invention can be used with excellent results as a laundry detergent and bleach. It can be used as an aqueous solution or as a free-flowing particulate solid composition. The aqueous solution is recited in the Summary, infra, and the free-flowing particulate solid is recited in Embodiment A, infra.

U.S. Pat. Nos. 3,539,463, 252/181, Harper et al, and 3,539,464, 252/18, Harper et al, inventors, teach detergent agents prepared from a borate (boric acid, sodium tetraborate, sodium metaborate, and mixtures thereof) and sodium glucoheptonates. These Harper et al patents are incorporated herein by reference.

U.S. Pat. No. 3,105,822, 252/156, Karabinos et al teach sodium glucoheptonate detergent solutions.

The following U.S. Patents, which are incorporated herein by reference, teach perborate bleaches:

| Patent No. | Class | Inventors |
|---|---|---|
| 3,553,140 | 252/99 | Lindner et al |
| 3,658,712 | 252/99 | Lindner et al |
| 3,661,789 | 252/186 | Corey et al |

SUMMARY OF THE INVENTION

In summary this invention is directed to an aqueous solution useful as a detergent and bleach prepared by a process comprising:

a. admixing;
   i. a first mixture of consisting essentially of substantially equal molar amounts of sodium α-glucoheptonate and sodium β-glucoheptonate;
   ii. sodium perborate; and
   iii. an amount of water effective for dissolving the sodium glucoheptonates and the sodium perborate to form a second mixture; and
b. agitating the second mixture to dissolve the glucoheptonates and the sodium perborate to form the aqueous solution.

The weight ratio of the sodium perborate to glucoheptonates can be 1:0.1–10 or 1:0.5–3.

The weight ratio of the sodium perborate to water in the aqueous solution can be 1:10–200 or 1:10–25.

The sodium perborate and the glucoheptonates are dissolved in water at 10°–80°C or 30°–60°C.

DESCRIPTION OF PREFERRED EMBODIMENTS

In a preferred embodiment ("Embodiment A") this invention is directed to a substantially free flowing particulate solid composition useful as a detergent and bleach prepared by a process comprising:

a. admixing;

i. a first mixture consisting essentially of substantially equal molar amounts of sodium α-glucoheptonate and sodium β-glucoheptonate;
   ii. sodium perborate; and
   iii. an amount of water effective for dissolving the sodium glucoheptonates and the sodium perborate to form a second mixture;
b. agitating the second mixtur to dissolve the glucoheptonates and the sodium perborate to form the aqueous solution; and
c. evaporating water from the aqueous solution to form the substantially free flowing particulate solid composition.

In the composition of Embodiment A the weight ratio of the sodium perborate to the glucoheptonate can be 1:0.1–10 or 1:0.5–3; the weight ratio of sodium perborate to water in the aqueous solution can be 1:10–200 or 1:10–50; the glucoheptonates and the sodium perborate are dissolved in water at 10°–80°C or 30°–60°C; the water can be evaporated from the aqueous solution at 25°–100°C, 25°–110°C, 5°–110°C or 35°–65°C; and the water can be evaporated from the aqueous solution at 2-760 Torr or at 25-200 Torr.

DETAILED DESCRIPTION OF THE INVENTION

The composition of this invention provides a convenient detergent and bleach for use in laundries including home laundries. In one embodiment the composition is provided as a liquid - an aqueous solution - while in another embodiment the composition is provided as a homogeneous, free flowing, particulate solid which is substantially non-hygroscopic.

The chemistry involved in the formation of the composition of this invention is not fully understood. However, it is believed that perborate esters of the α-glucoheptonate and β-glucoheptonate moieties are present in the composition whether it (the composition) is a solid composition or an aqueous solution. My invention is completely independent of and in no way dependent on such theory whether or not the theory should prove correct.

Where using the composition of this invention as a laundry detergent and bleach excellent results can be obtained by using about 6–12 grams of the particulate solid composition (or an amount of the aqueous solution which contains about 6–12 grams of said solid) per U.S. gallon of water used to launder and bleach soiled textile material such as white shirts, cotton sheets, table cloths, underclothing, and the like. As a further advantage, the composition of this invention does not produce "yellowing" where used as a detergent and bleach for laundering white wash and wear shirts or other wash and wear or permanently pressed white textile items.

The instant invention will be better understood by the following specific but nonlimiting examples. It is understood that modification can be made without departing from the spirit and scope of the invention.

EXAMPLE 1

An aqueous solution of the type recited in the above Summary was prepared by admixing; (*a*) 52.5 parts by weight of sodium glucoheptonate, the sodium glucoheptonate being a mixture (1:1 mole ratio) of sodium α-glucoheptonate and sodium β-glucoheptonate; (*b*) 47.5 parts by weight of sodium perborate, and (*c*) 641 parts by weight of water. The resulting mixture was agitated at 60°C to dissolve the solid components (i.e., the sodium glucoheptonate and the sodium perborate)

thereby to form a readily pourable substantially colorless aqueous solution (the aqueous solution or composition of my invention) which was designated "Composition 1".

EXAMPLE 2

The procedure of Example 1 was repeated. The lot of Composition 1 prepared in this run was evaporated to dryness by maintaining it (said lot of Composition 1) under a pressure of 5 inches of mercury absolute and at a temperature of 60°C for 16 hours. The product, the free flowing particulate solid of this invention, was a nearly white crystalline, free flowing, particulate solid which passed a 10 mesh (US Standard) screen. It (said solid product) was designated "Composition 2".

EXAMPLE 3

The general procedure of Example 1 was repeated; however, in this instance the procedure was modified by using 67.7 parts of the sodium glucoheptonate, 32.3 parts of the sodium perborate, and 641 parts of water (all parts being by weight). The resulting liquid product was designated "Composition 3".

EXAMPLE 4

A second lot of Composition 3 was prepared using the procedure of Example 3. The second lot of Composition 3 was evaporated to dryness using the general procedure of Example 2. The resulting product, the free flowing particulate solid of this invention, was a nearly white, crystalline, free flowing particulate solid which was designated "Composition 4".

EXAMPLE 5

The general procedure of Example 1 was repeated. However, in this instance the procedure was modified by using 37.2 parts of the sodium glucoheptonate, 62.8 parts of the sodium perborate, and 641 parts of water. The liquid product, the aqueous solution of this invention, was designated "Composition 5".

EXAMPLE 6

A second lot of Composition 5 was made according to the procedure of Example 5. The second lot of Composition 5 was evaporated to dryness using the general procedure of Example 2. The resulting product, the free flowing particulate solid of this invention, was a nearly white, crystalline, free flowing, particulate solid which was designated "Composition 6".

I claim:

1. A substantially free flowing particulate solid composition useful as a detergent and bleach prepared by a process consisting essentially of:

a. admixing;
   i. a first mixture consisting essentially of substantially equal molar amounts of sodium $\alpha$-glucoheptonate and sodium $\beta$-glucoheptonate;
   ii. sodium perborate; and
   iii. an amount of water effective for dissolving the sodium glucoheptonates and the sodium perborate to form a second mixture;
b. agitating the second mixture to dissolve the glucoheptonates and the sodium perborate to form the aqueous solution; and
c. evaporating water from the aqueous solution to form the substantially free flowing particulate solid composition.

2. The composition of claim 1 in which the weight ratio of the sodium perborate to the glucoheptonates is 1:0.1–10.

3. The composition of claim 1 in which the weight ratio of sodium perborate to water in the aqueous solution is 1:10–200.

4. The composition of claim 1 in which the glucoheptonates and the sodium perborate are dissolved in water 10°–80°C.

5. The composition of claim 1 in which water is evaporated from the aqueous solution at 25°–110°C.

6. The composition of claim 1 in which water is evaporated from the aqueous solution at 2-760 Torr and 25°–100°C.

7. The composition of claim 2 in which the weight ratio of sodium perborate to the glucoheptonates is 1:0.5–3.

* * * * *